US009615612B2

(12) United States Patent
Duffy

(10) Patent No.: US 9,615,612 B2
(45) Date of Patent: Apr. 11, 2017

(54) FILTERING FACE-PIECE RESPIRATOR WITH STIFFENING MEMBER INTEGRAL WITH FILTERING STRUCTURE

(71) Applicant: 3M INNOVATIVE PROPERTIES COMPANY, St. Paul, MN (US)

(72) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 470 days.

(21) Appl. No.: 14/013,214

(22) Filed: Aug. 29, 2013

(65) Prior Publication Data

US 2015/0059771 A1 Mar. 5, 2015

(51) Int. Cl.
*A41D 13/11* (2006.01)
*A62B 23/02* (2006.01)

(52) U.S. Cl.
CPC ..... *A41D 13/1115* (2013.01); *A41D 13/1161* (2013.01); *A62B 23/025* (2013.01); *Y10T 29/49604* (2015.01)

(58) Field of Classification Search
CPC ..... A62B 23/025; A62B 23/00; A62B 23/02; A62B 23/06
See application file for complete search history.

(56) References Cited

U.S. PATENT DOCUMENTS 3,888,246 A * 6/1975 Lauer ..... A41D 13/1115 128/201.17
3,971,369 A 7/1976 Aspelin et al.
3,985,132 A * 10/1976 Boyce ..... A41D 13/1115 128/206.19
4,248,220 A 2/1981 White
4,300,549 A 11/1981 Parker
4,606,341 A 8/1986 Hubbard et al.
4,688,566 A 8/1987 Boyce
5,765,556 A 6/1998 Brunson
6,336,459 B1 1/2002 Miyake et al.
6,394,090 B1 5/2002 Chen et al.
6,427,693 B1 8/2002 Blackstock et al.
7,036,507 B2 5/2006 Jensen
7,677,248 B2 3/2010 Gerson et al.
2004/0163649 A1* 8/2004 Shao ..... A41D 13/1192 128/205.27
2010/0154805 A1 6/2010 Duffy et al.
(Continued)

FOREIGN PATENT DOCUMENTS

EP 0894443 3/2003
EP 2589413 5/2013
(Continued)

OTHER PUBLICATIONS

International Application PCT/US2014/051975 dated May 13, 2015.

*Primary Examiner* — Tarla Patel

(57) ABSTRACT

A filtering face-piece respirator 10 having a mask body 12 formed of a filtering structure 16. The mask body 12 has at least one transversely extending stiffening member 50, formed by an s-shaped or tri-fold pleat permanently connected, such as by welding. The at least one stiffening member 50 increases the integrity of the mask body 12, when in the opened cup-shaped configuration, inhibiting collapse of the mask body, due to, for example, increased pressure drop across the mask body 12 due to dirty or moisture laden air.

11 Claims, 5 Drawing Sheets

(56) References Cited

U.S. PATENT DOCUMENTS

2012/0325843 A1 12/2012 Tsuei

FOREIGN PATENT DOCUMENTS

| | | |
|---|---|---|
| GB | 2025773 | 1/1980 |
| GB | 2045093 | 10/1980 |
| JP | 3126242 | 10/2006 |
| WO | WO 01/89330 | 11/2001 |
| WO | WO 2010/038639 | 4/2010 |

* cited by examiner

FILTERING FACE-PIECE RESPIRATOR WITH STIFFENING MEMBER INTEGRAL WITH FILTERING STRUCTURE

The present invention pertains to a filtering face-piece respirator that includes at least one strengthening rib transversely extending across the respirator.

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. No. RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. These filtering face-piece respirators commonly come in one of two configurations: molded respirators and flat-fold respirators.

Molded filtering face piece respirators have regularly comprised non-woven webs of thermally-bonding fibers or open-work plastic meshes to furnish the mask body with its cup-shaped configuration. Molded respirators tend to maintain the same shape during both use and storage. These respirators therefore cannot be folded flat for storage and shipping. Examples of patents that disclose molded, filtering face-piece respirators include U.S. Pat. No. 7,131,442 to Kronzer et al, U.S. Pat. Nos. 6,923,182, 6,041,782 to Angadjivand et al., U.S. Pat. No. 4,807,619 to Dyrud et al., and U.S. Pat. No. 4,536,440 to Berg.

Flat-fold respirators—as their name implies—can be folded flat for shipping and storage. They also can be opened into a cup-shaped configuration for use. Examples of flat-fold respirators are shown in U.S. Pat. Nos. 6,568,392 and 6,484,722 to Bostock et al., and U.S. Pat. No. 6,394,090 to Chen. Some flat-fold respirators have been designed with weld lines, seams, and folds, to help maintain their cup-shaped configuration during use. Stiffening members also have been incorporated into panels of the mask body (see U.S. Patent Application Publications 2001/0067700 to Duffy et al., 2010/0154805 to Duffy et al., and U.S. Design Pat. No. 659,821 to Spoo et al.).

The present invention, as described below, provides flat-fold respirators with improved stiffening members.

SUMMARY OF THE INVENTION

The present invention provides a filtering face-piece respirator that comprises a mask body having at least one transversely extending stiffening member, formed by an S-shaped or tri-folded pleat permanently connected, such as by welding. Depending on the position and width of the connection area in relation to the area of the S-shaped or tri-folded pleat, the resulting stiffening member may have a rib on either or each side of the connection area. These ribs may form a channel or gutter on the interior surface of the mask body.

The at least one stiffening member increases the integrity of the mask body, when in the opened cup-shaped configuration, inhibiting collapse of the mask body, due to, for example, increased pressure drop across the mask body due to dirty or moisture laden air. By having the stiffening member extending transversely across the mask body, from side-to-side, when the mask body is formed into a cup-shape, a reinforcing truss structure is formed, further inhibiting the collapse of the formed mask body. Any channel or gutter formed by the stiffening member provides a liquid management system to transport undesirable liquid, condensed from the moisture laden air, away from the wearer's face.

In one particular embodiment, the stiffening member is formed by folding (pleating) and then welding together three layers of the filtering structure that forms the mask body. The resulting stiffening member has a thickness at the weld location that is less than the thickness of the filtering structure and a thickness on both sides of the weld that is two to three times the thickness of the filtering structure.

GLOSSARY

The terms set forth below will have the meanings as defined:

"comprises" or "comprising" means its definition as is standard in patent terminology, being an open-ended term that is generally synonymous with "includes", "having", or "containing" Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"connection region" means the region of the stiffening member where three layers of the filtering structure are permanently connected together;

"contaminants" means particles (including dusts, mists, and fumes) and/or other substances that generally may not be considered to be particles (e.g., organic vapors, etc.) but which may be suspended in air;

"crosswise dimension" is the dimension that extends laterally across the respirator, from side-to-side when the respirator is viewed from the front;

"cup-shaped configuration", and variations thereof, mean any vessel-type shape that is capable of adequately covering the nose and mouth of a person;

"exterior gas space" means the ambient atmospheric gas space into which exhaled gas enters after passing through and beyond the mask body and/or exhalation valve;

"exterior surface" means the surface of the mask body exposed to ambient atmospheric gas space when the mask body is positioned on the person's face;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" and "breathable filtering structure" each means a generally air-permeable construction that filters air;

"folded inwardly" means being bent back towards the part from which extends;

"harness" means a structure or combination of parts that assists in supporting the mask body on a wearer's face;

"integral" means being made together; that is, being made together as one part and not two separately manufactured parts that are subsequently joined together;

"interior gas space" means the space between a mask body and a person's face;

"interior perimeter" means the outer edge of the mask body, on the interior surface of the mask body, which would be disposed generally in contact with a wearer's face when the respirator is positioned on the wearer's face;

"interior surface" means the surface of the mask body closest to a person's face when the mask body is positioned on the person's face;

"line of demarcation" means a fold, seam, weld line, bond line, stitch line, hinge line, and/or any combination thereof;

"mask body" means an air-permeable structure that is designed to fit over the nose and mouth of a person and that helps define an interior gas space separated from an exterior gas space (including the seams and bonds that join layers and parts thereof together);

"nose clip" means a mechanical device (other than a nose foam), which device is adapted for use on a mask body to improve the seal around a wearer's nose;

"perimeter" means the outer edge of the mask body, which outer edge would be disposed generally proximate to a wearer's face when the respirator is being donned by a person; a "perimeter segment" is a portion of the perimeter;

"pleat" means a portion that is designed to be or is folded back upon itself;

"polymeric" and "plastic" each mean a material that mainly includes one or more polymers and that may contain other ingredients as well;

"respirator" means an air filtration device that is worn by a person to provide the wearer with clean air to breathe;

"stiffening member" means an elongate element integral with the filtering structure and with breathable filtering structure on each side of the stiffening member, which increases the rigidity of the filtering structure in the direction of the stiffening member; and "transversely extending" means extending generally in the crosswise dimension.

DETAILED DESCRIPTION OF PREFERRED EMBODIMENTS

Figure 1:
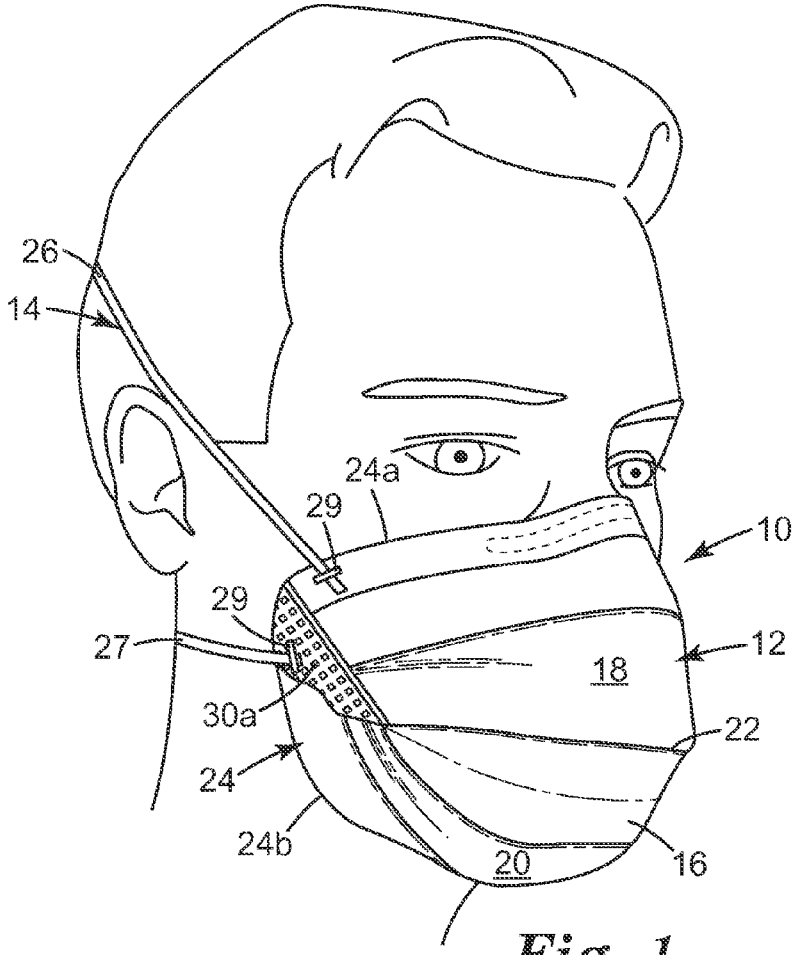
FIG. 1 is a front perspective view of a flat-fold filtering face-piece respirator 10 being worn on a person's face.

In practicing the present invention, a filtering face-piece respirator is provided that has at least one stiffening member transversely extending across the face mask of the respirator. The stiffening member enhances the fit and inhibits collapse of the face mask toward the face of the wearer while allowing fluid (e.g., moisture laden air) to permeate from the interior gas space to the exterior gas space.

In the following description, reference is made to the accompanying drawings that form a part hereof and in which are shown by way of illustration various specific embodiments. The various elements and reference numerals of one embodiment described herein are consistent with and the same as the similar elements and reference numerals of another embodiment described herein, unless indicated otherwise. It is to be understood that other embodiments are contemplated and may be made without departing from the scope or spirit of the present invention. The following description, therefore, is not to be taken in a limiting sense. While the present invention is not so limited, an appreciation of various aspects of the invention will be gained through a discussion of the examples provided below.

Figure 2:
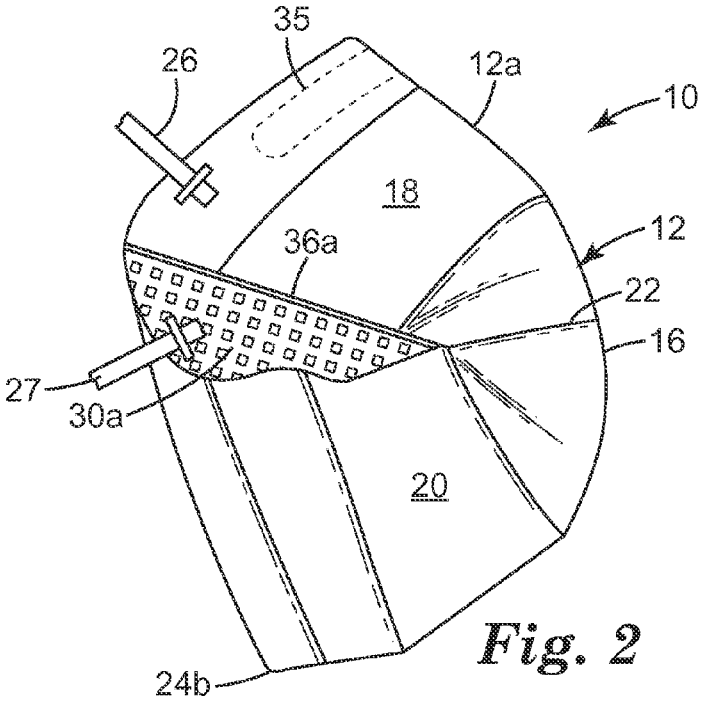
FIG. 2 is a side view of the respirator 10 of FIG. 1.

Turning to the figures, FIGS. 1 and 2 show an example of a filtering face-piece respirator 10 that may be used in connection with the present invention to provide clean air for the wearer to breathe. The filtering face-piece respirator 10 includes a mask body 12 and a harness 14.

Figure 3:
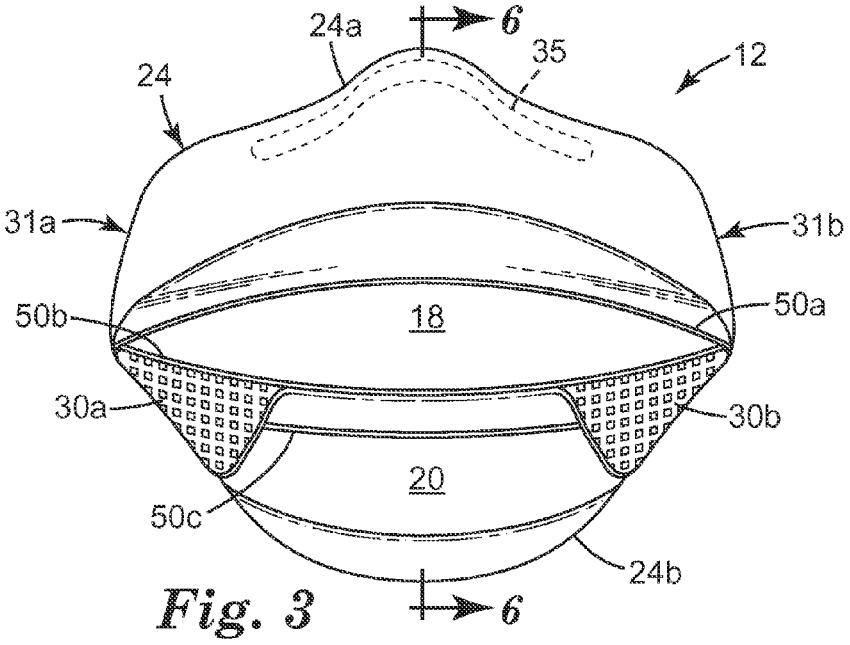
FIG. 3 is a front view of a mask body 12 of respirator 10 of FIG. 1.
Figure 4A:
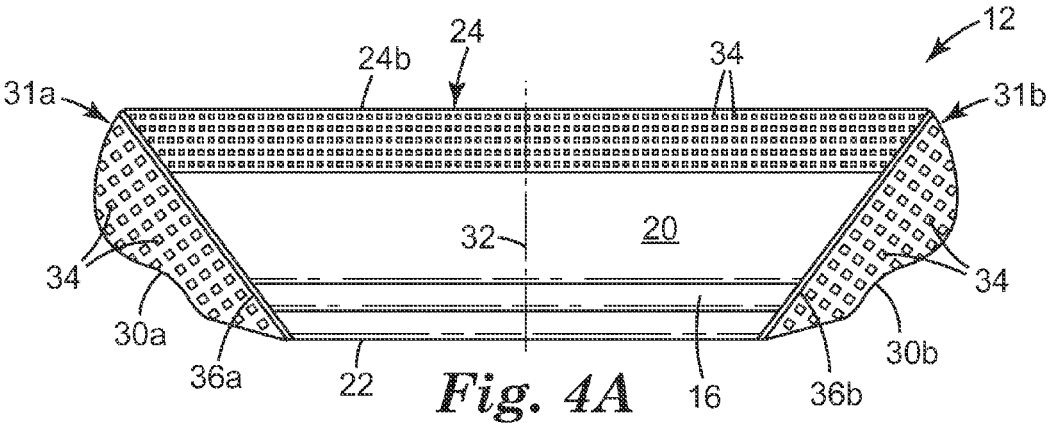
FIG. 4*a* is a bottom view of the mask body 12 in a flat configuration with the flanges 30*a*, 30*b* in an unfolded position.
Figure 4B:
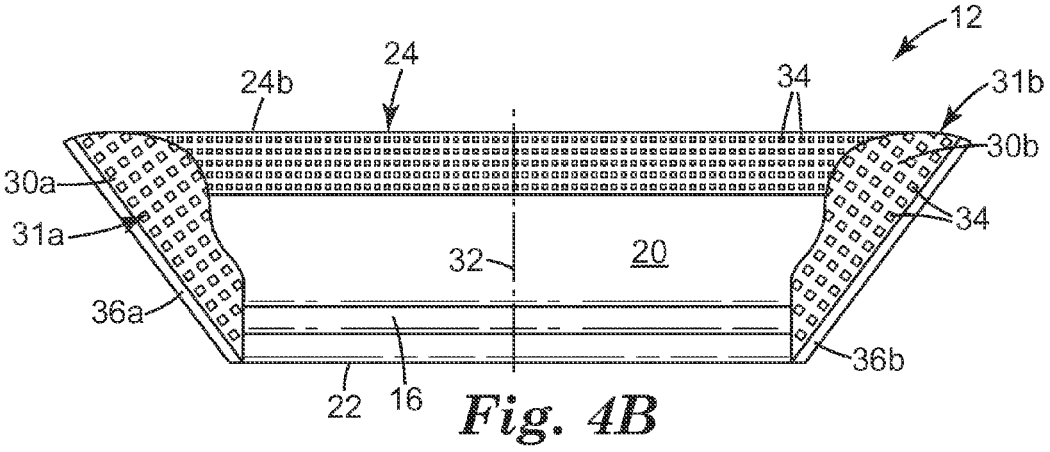
FIG. 4*b* is a bottom view of the mask body 12 in a pre-opened configuration with the flanges 30*a*, 30*b* folded against the filtering structure 16.

FIG. 3 shows the mask body 12 of the respirator 10 without the harness 14, FIGS. 4*a* and 4*b* show the mask body 12 in a folded or collapsed configuration; this configuration may also be referred to as a pre-opened configuration. Additional features and details of respirator 10 and mask body 12 can be seen in these configurations.

The mask body 12 has a filtering structure 16 through which inhaled air must pass before entering the wearer's respiratory system. The filtering structure 16 removes contaminants from the ambient environment so that the wearer breathes clean air. The filtering structure 16 may take on a variety of different shapes and configurations and typically is adapted so that it properly fits against the wearer's face or within a support structure. Generally the shape and configuration of the filtering structure 16 corresponds to the general shape of the mask body 12.

The mask body 12 includes a top portion 18 and a bottom portion 20 separated by a line of demarcation 22. In this particular embodiment, the line of demarcation 22 is a fold or pleat that extends transversely across the central portion of the mask body from side-to-side. The mask body 12 also includes a perimeter 24 that includes an upper segment 24*a* at top portion 18 and a lower segment 24*b* at bottom portion 20.

The harness 14 (FIG. 1) has a first, upper strap 26 that is secured to the top portion 18 of mask body 12 and a second, lower strap 27. The straps 26, 27 are secured to mask body 12 by staples 29. The straps 26, 27 may be made from a variety of materials, such as thermoset rubbers, thermoplastic elastomers, braided or knitted yarn and/or rubber combinations, inelastic braided components, and the like. The straps 26, 27 preferably can be expanded to greater than twice their total length and be returned to their relaxed state. The straps 26, 27 also could possibly be increased to three or four times their relaxed state length and can be returned to their original condition without any damage thereto when the tensile forces are removed. The straps 26, 27 may be continuous straps or may have a plurality of parts, which can be joined together by further fasteners or buckles. Alternatively, the straps may form a loop that is placed around the wearer's ears.

FIGS. 3, 4*a* and 4*b* show the mask body 12 with first and second flanges 30*a* and 30*b* located on opposing sides 31*a*, 31*b* of the mask body 12. Each of the straps 26, 27 extend from side 31*a* to side 31*b*. As indicated above, the first, upper strap 26 is secured to the top portion 18 of mask body 12 adjacent to the perimeter upper segment 24*a*, whereas the second, lower strap 27 is stapled to flanges 30*a*, 30*b*, which are folded inwardly towards the filtering structure 16 in FIG. 4*b*. Additional details regarding flanges 30*a* and 30*b* and other features of respirator 10 and mask body 12 can be found in U.S. patent application Ser. No. 13/727,923 filed Dec. 27, 2012, titled "Filtering Face-Piece Respirator Having Folded Flange," the entire disclosure of which is incorporated herein by reference.

A nose clip 35 (FIGS. 2, 3) can be disposed on the top portion 18 of the mask body 12 adjacent to the upper perimeter segment 24*a*, centrally positioned between the mask body side edges 31*a*, 31*b*, to assist in achieving an appropriate fit on and around the nose and upper cheek bones. The nose clip 35 may be made from a pliable metal or plastic that is capable of being manually adapted by the wearer to fit the contour of the wearer's nose. The nose clip 35 may comprise, for example, a malleable or pliable soft band of metal such as aluminum, which can be shaped to hold the mask in a desired fitting relationship over the nose of the wearer and where the nose meets the cheek.

Turning to FIGS. 4*a* and 4*b*, a plane 32 bisects the mask body 12 to define the first and second sides 31*a*, 31*b*. The first and second flanges 30*a* and 30*b* located on opposing sides 31*a* and 31*b*, respectively, of the mask body 12 can be readily seen in FIG. 4*a*. The flanges 30*a*, 30*b* typically extend away from the mask body 12 and may be integrally or non-integrally connected to the major portion of the mask body 12 at first and second lines of demarcation 36*a*, 36*b*. Although the flanges 30*a*, 30*b* may comprise one or more or all of the various layers that comprise the mask body filtering structure 16, the flanges 30*a*, 30*b* are not part of the primary filtering area of the mask body 12. Unlike the filtering structure 16, the layers that comprise the flanges 30*a*, 30*b* may be compressed, rendering them nearly fluid impermeable. The flanges 30*a*, 30*b* may be an extension of the material used to make the mask body filtering structure 16, or they may be made from a separate material such as a rigid or semi-rigid plastic. The flanges 30*a*, 30*b* may be rotated or folded about an axis or fold line generally parallel, close to parallel, or at an angle of no more than about 30 degrees to these demarcation lines 36*a*, 36*b* to form the configuration of FIG. 4*b*. Further, the flanges 30*a*, 30*b* can have welds or bonds 34 thereon to increase flange stiffness, and the mask body perimeter lower segment 24*b* also may have a series of bonds or welds 34 to join the various layers of the mask body 12 together.

Perimeter segment 24*a* (FIGS. 1, 3, 6) also may have a series of bonds or welds to join the various layers together and also to maintain the position of the nose clip 35. The remainder of the filtering structure 16—inwardly from the perimeter—may be fully fluid permeable over much of its extended surface, with the possible exception of areas where there are bonds, welds, or fold lines.

The filtering structure 16 that is used in the mask body 12 can be of a particle capture or gas and vapor type filter. The filtering structure 16 also may be a barrier layer that prevents the transfer of liquid from one side of the filter layer to another to prevent, for instance, liquid aerosols or liquid splashes (e.g., blood) from penetrating the filter layer. Multiple layers of similar or dissimilar filter media may be used to construct the filtering structure 16 as the application requires. Filtration layers that may be beneficially employed in a layered mask body are generally low in pressure drop (for example, less than about 195 to 295 Pascals at a face velocity of 13.8 centimeters per second) to minimize the breathing work of the mask wearer. Filtration layers additionally may be flexible and may have sufficient shear strength so that they generally retain their structure under the expected use conditions.

Figure 5:
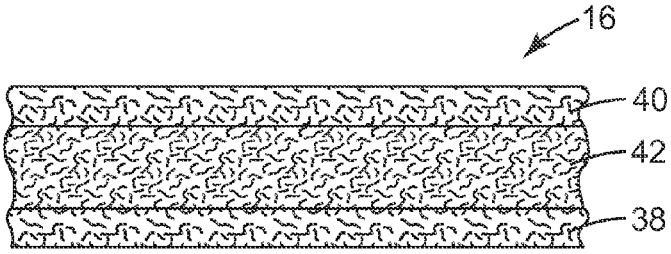
FIG. 5 is a cross-sectional view of a filtering structure 16 suitable for use in the mask body 12 of FIG. 1.

FIG. 5 shows an exemplary filtering structure 16 having multiple layers such as an inner cover web 38, an outer cover web 40, and a filtration layer 42. The filtering structure 16 also may have a structural netting or mesh juxtaposed against at least one or more of the layers 38, 40, or 42, typically against the outer surface of the outer cover web 40, that assist in providing a cup-shaped configuration. The filtering structure 16 also could have one or more horizontal and/or vertical lines of demarcation (e.g., pleat, fold, or rib) that contribute to its structural integrity.

An inner cover web 38, which typically defines the interior surface of the mask body 12, can be used to provide a smooth surface for contacting the wearer's face, and an outer cover web 40, which typically defines the exterior surface 12*a* (FIG. 2) of the mask body 12, can be used to entrap loose fibers in the mask body or for aesthetic reasons. Both cover webs 38, 40 protect the filtration layer 42. The cover webs 38, 40 typically do not provide any substantial filtering benefits to the filtering structure 16, although outer cover web 40 can act as a pre-filter to the filtration layer 42.

To obtain a suitable degree of comfort, the inner cover web 38 preferably has a comparatively low basis weight and is formed from comparatively fine fibers, often finer than those of outer cover web 40. Either or both cover webs 38, 40 may be fashioned to have a basis weight of about 5 to about 70 g/m$^2$ (typically about 17 to 51 g/m$^2$ and in some embodiments 34 to 51 g/m$^2$), and the fibers may be less than 3.5 denier (typically less than 2 denier, and more typically less than 1 denier) but greater than 0.1. Fibers used in the cover webs 38, 40 often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Typically, the cover webs 38, 40 are made from a selection of nonwoven materials that provide a comfortable feel, particularly on the side of the filtering structure that makes contact with the wearer's face, i.e., inner cover web 38. Suitable materials for the cover web may be blown microfiber (BMF) materials, particularly polyolefin BMF materials, for example polypropylene BMF materials (including polypropylene blends and also blends of polypropylene and polyethylene). Spun-bond fibers also may be used.

A typical cover web may be made from polypropylene or a polypropylene/polyolefin blend that contains 50 weight percent or more polypropylene. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. Cover webs 38, 40 preferably have very few fibers protruding from the web surface after processing and therefore have a smooth outer surface.

The filtration layer 42 is typically chosen to achieve a desired filtering effect. The filtration layer 42 generally will remove a high percentage of particles and/or or other contaminants from the gaseous stream that passes through it. For fibrous filter layers, the fibers selected depend upon the kind of substance to be filtered.

The filtration layer 42 may come in a variety of shapes and forms and typically has a thickness of about 0.2 millimeters (mm) to 5 mm, more typically about 0.3 mm to 3 mm (e.g., about 0.5 mm), and it could be a generally planar web or it could be corrugated to provide an expanded surface area. The filtration layer also may include multiple filtration layers joined together by an adhesive or any other means. Essentially any suitable material that is known (or later developed) for forming a filtering layer may be used as the filtering material. Webs of melt-blown fibers, especially when in a persistent electrically charged (electret) form are especially useful. Electrically charged fibrillated-film fibers also may be suitable, as well as rosin-wool fibrous webs and webs of glass fibers or solution-blown, or electrostatically sprayed fibers, especially in microfilm form. Also, additives can be included in the fibers to enhance the filtration performance of webs produced through a hydro-charging process. Fluorine atoms, in particular, can be disposed at the surface of the fibers in the filter layer to improve filtration performance in an oily mist environment.

Examples of particle capture filters include one or more webs of fine inorganic fibers (such as fiberglass) or polymeric synthetic fibers. Synthetic fiber webs may include electret-charged, polymeric microfibers that are produced from processes such as meltblowing. Polyolefin microfibers formed from polypropylene that has been electrically-charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures. A sorbent layer can be formed by coating a substrate, such as fibrous or reticulated foam, to form a thin coherent layer. Sorbent materials may include activated carbons that are chemically treated or not, porous alumina-silica catalyst substrates, and alumina particles.

Although the filtering structure 16 has been illustrated in FIG. 5 with one filtration layer 42 and two cover webs 38, 40, the filtering structure 16 may comprise a plurality or a combination of filtration layers 42. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors.

During respirator use, incoming air passes sequentially through layers 40, 42, and 38 before entering the mask interior. The air that is within the interior gas space of the mask body may then be inhaled by the wearer. When a wearer exhales, the air passes in the opposite direction sequentially through layers 38, 42, and 40. Alternatively, an exhalation valve (not shown) may be provided on the mask body 12 to allow exhaled air to be rapidly purged from the interior gas space to enter the exterior gas space without passing through filtering structure 16. The use of an exhalation valve may improve wearer comfort by rapidly removing the warm moist exhaled air from the mask interior. Essentially any exhalation valve that provides a suitable pressure drop and that can be properly secured to the mask body may be used in connection with the present invention to rapidly deliver exhaled air from the interior gas space to the exterior gas space.

The respirators of this invention include at least one stiffening member extending transversely across the mask body 12, from side 31*a* to side 31*b*. The stiffening member(s) are formed by a triple layer of the filtering structure 16.

Figure 6:
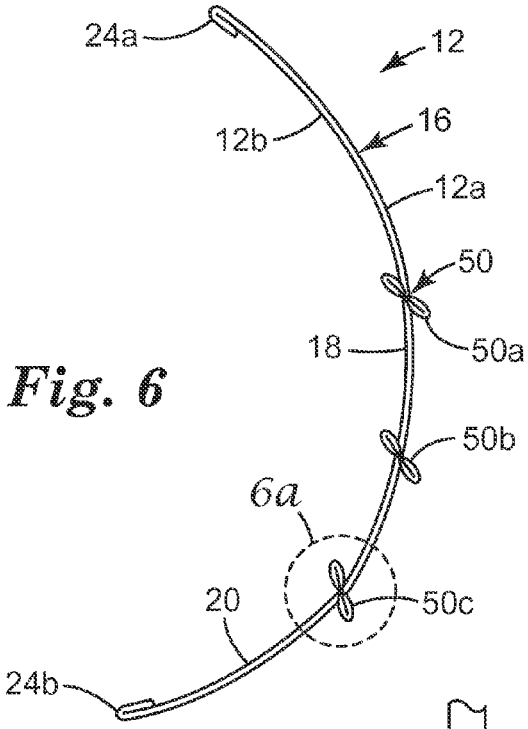
FIG. 6 is a cross-sectional view of the mask body 12, taken along lines 6-6 of FIG. 3, showing the three stiffening members 50.

Turning to FIG. 6, the mask body 12 is shown, including the exterior surface 12*a* of the mask body 12 and the opposite interior surface 12*b*. Integrally formed with the filtering structure 16 of the mask body 12 is at least one stiffening member 50; the illustrated mask body 12 has three stiffening members 50*a*, 50*b*, and 50*c*. The stiffening member 50*a* is positioned in the top portion 18, the stiffening member 50*b* is positioned approximately at the line of demarcation 22 (FIGS. 1 and 2) and the stiffening member 50*c* is positioned in the bottom portion 20 of the mask body 12. In the illustrated embodiment, the stiffening members 50*a*, 50*c* are essentially equidistant from the stiffening member 50*b*; that is, the distance between the stiffening member 50*a* and the stiffening member 50*b* is essentially the same as the distance between the stiffening member 50*b* and the stiffening member 50*c*. Of course, different spacings for multiple stiffening members 50 could be utilized.

Each stiffening member 50 is formed by three layers of the filtering structure 16 joined together to form a rib, support, brace, strut, beam, or other stiffening feature. Each member 50 has a rib 52 present in the interior gas space of mask body 12 proximate the interior surface 12*b* and a rib 54 present in the exterior gas space of mask body 12, proximate the exterior surface 12*a*. A connection region 55 that extends the length of the stiffening member 50 forms the ribs 52, 54, which are unwelded loops of the filtering structure 16; that is, ribs 52, 54 are formed by juxtaposed unwelded layers of the filtering structure 16. Connection region 55 is the region where three layers of the filtering structure 16 are permanently connected together, for example, by adhesive, mechanical attachment (e.g., sewing, staples, etc.), or by welding (e.g., ultrasonic and/or thermal welding, which includes heat and pressure).

The stiffening member(s) 50 extend transversely across the mask body 12, preferably forming a continuous member from side 31*a* to side 31*b*. In some embodiments, the stiffening member 50 is a continuous interrupted feature (e.g., a dashed or stitched line) extending from side 31*a* to side 31*b*. Stiffening member 50, due to its increased thickness compared to the rest of the mask body 12 generally, and/or due to the rigidity of the connection region 55, increases the resistance of mask body 12 to collapsing inward, toward the face of the wearer.

Figure 6A:
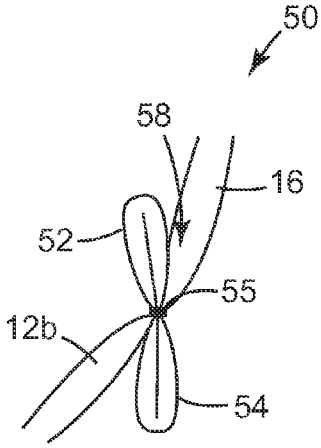
FIG. 6*a* is an enlarged view of stiffening member 50 shown in FIG. 6.

In some embodiments, including the one illustrated in FIG. 6, inner rib 52 is the upper-most rib of the two ribs, positioned above connection region 55 and outer rib 54 when the mask body 12 is positioned on the face of a wearer. In this embodiment, the inner rib 52 forms a channel or gutter 58 with filtering structure 16 above connection region 55 as shown in FIG. 6*a*, which is an enlarged view of stiffening member 50 shown in FIG. 6. This gutter 58 can collect, retain, and optionally transport liquid that might coalesce on interior surface 12*b* of mask body 12 and drain into gutter 58.

Figure 7:
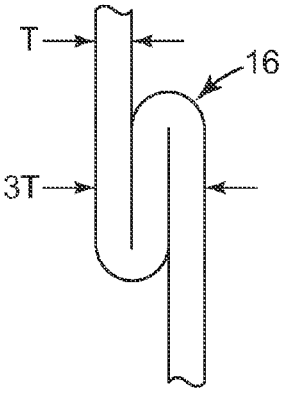
FIG. 7 is a schematic plan view of the filtering structure 16 folded prior to being welded to form a stiffening member 50.
Figure 8:
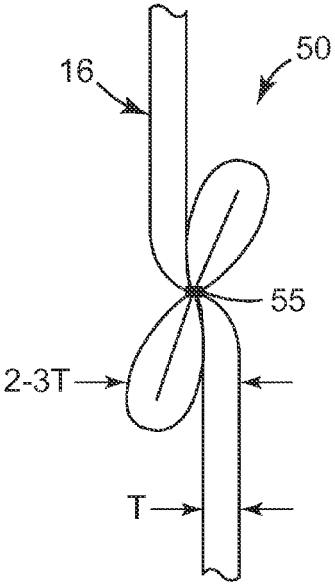
FIG. 8 is a schematic plan view of the filtering structure 16 folded and welded to form a stiffening member 50.

FIGS. 7 and 8 show the filtering structure 16 that forms the stiffening member 50, prior to and after connection (e.g., welding) at connection region 55. In FIG. 7, a single piece of the filtering structure 16, having a thickness (T), is twice-folded or pleated to form an "s" shape. This s-shaped region of the folded structure 16, which will eventually form the connection region and the ribs, has a thickness of 3(T), or three times the thickness (T) of the filtering structure 16. After the connection region 55 has been formed, in FIG. 8, the connection region 55, particularly if formed by welding, has a thickness that is significantly less than 3(T), typically no greater than the thickness (T) of the filtering structure 16. However, depending on the mechanism of connection, the thickness in the connection region 55 can range from less than to 3(T) or even more than 3(T). For example, if an adhesive is used between the three layers of filtering structure 16, the resulting connection region 55 may have a thickness greater than 3(T). The overall thickness of the stiffening member 50, measured at either rib 52 or rib 54, is between about 2(T) to 3(T), e.g., about 2.4(T) or 2.5(T). The ribs 52, 54 themselves each has a thickness between about 1(T) to about 2(T).

The ribs 52, 54 typically have a length, measured from the connection region 55 to their tip, of about 1 mm to 5 mm for each rib 52, 54; the overall distance from tip to tip is typically 2 mm to 1 cm. If the connection region 55 is not centered, uneven length ribs 52, 54 will be formed. The width of the connection region 55, between the ribs 52, 54, is dependent on the mechanism of connection. As an example, a welded connection region 55 can have a width of about 1 mm.

Figure 9:
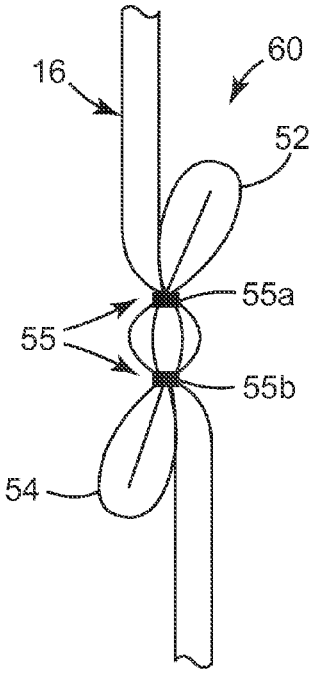
FIG. 9 is a schematic plan view of the filtering structure 16 folded and welded to form an alternate stiffening member 60.

FIG. 9 shows an alternate configuration for a stiffening member 60. In FIG. 9, the filtering structure 16, having a thickness (T), is twice-folded or pleated to form an "s" shape. Within the s-pleat is a connection region 55 formed by multiple connection region portions 55*a*, 55*b*. That is, the stiffening member 60 has multiple connection regions (e.g., welded connection regions), in this embodiment, two. Depending on the placement of and width of the connection region portions 55*a*, 55*b* in relation to the overall length of the s-pleat, ribs 52, 54 may be present on the outer sides of the connection region 55, or the connection region portions 55*a*, 55*b* may be sufficiently close to the edge of the s-pleat that no rib 52, 54 is discernible.

The various thicknesses for the elements of the stiffening member 60 can be the same as described above, however, again depending on the position and width of the two connection region portions 55*a*, 55*b*, the ribs 52, 54 may have a length, if at all even measurable, of about 0.2 mm to 1 mm for each rib 52, 54.

In another alternate configuration of a stiffening member, the connection region may be sufficiently wide to occupy the entire area of the s-pleat. Such a connection region may be continuous or may be patterned, such as a knurled pattern.

Figure 10:
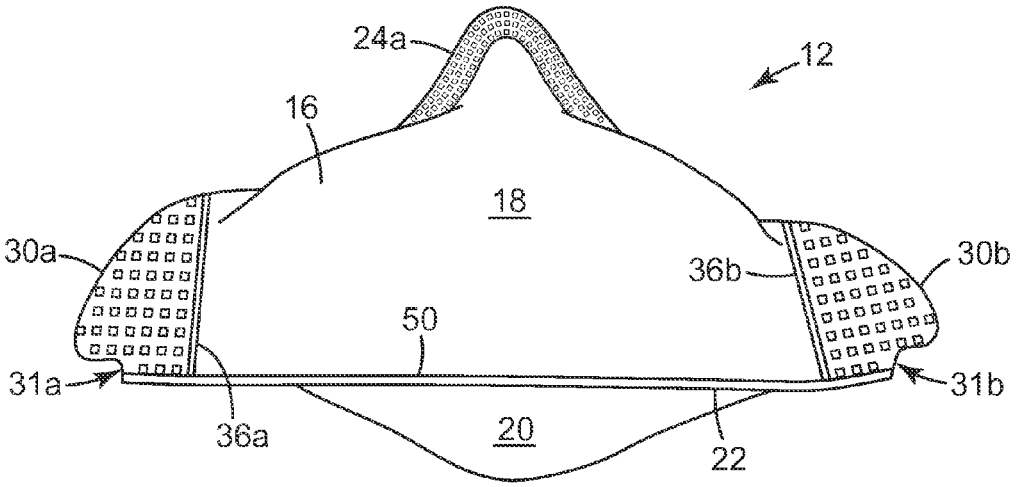
FIG. 10 is a front view of an alternate embodiment of a mask body 12 illustrating a stiffening member 50.
Figure 11:
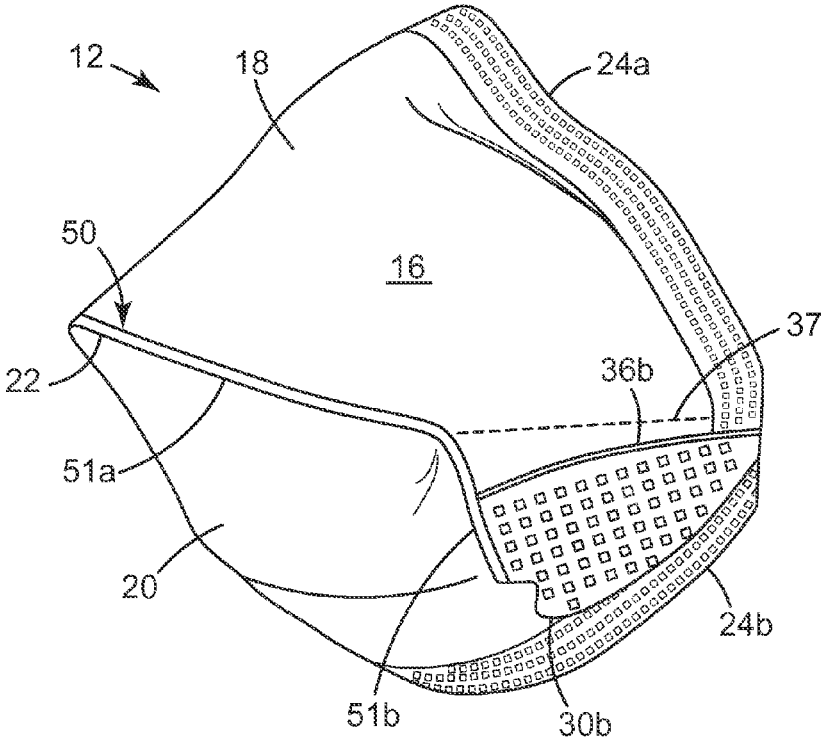
FIG. 11 is a side view of the mask body 12 of FIG. 10 showing the stiffening member 50.

Another embodiment of a mask body 12 having at least one stiffening member 50 is illustrated in FIGS. 10 and 11. This mask body 12, the same as the previous example, has the top portion 18 and the bottom portion 20 divided by a line of demarcation 22, which, in this embodiment, is a stiffening member 50. Stiffening member 50 extends from side edge 31*a* to side edge 31*b* in a continuous manner and continues along flanges 30*a* and 30*b*. In FIG. 10, the mask body 12 is in a partially opened configuration, with the flanges 30*a*, 30*b* extending out from the mask body 12, not yet folded in contact with the filtering structure 16. In FIG. 11, flanges 30*a*, 30*b* are folded along the fold line 37 to form the cup-shaped mask body 12. Although only flange 30*b* and its respective fold line are seen in FIG. 11, the other side of the mask body 12 includes a fold line 37 proximate the other flange 30*a*. In this embodiment, the fold line 37 is spaced from the demarcation line 36*b*. Folding the flange 30*b* along the line 37 to contact the filtering structure 16 results in the stiffening member 50 forming a 3-sided trapezoidal-like shape having one base side 51*a* and two legs 51*b*. As before, the base side 51*a*, extending transversely, increases the resistance of the mask body 12 to collapsing inward, toward the face of the wearer. The legs 51*b* increase the stiffness of the mask body 12 vertically, inhibiting collapsing downward when positioned on the face of the wearer.

Figure 12:
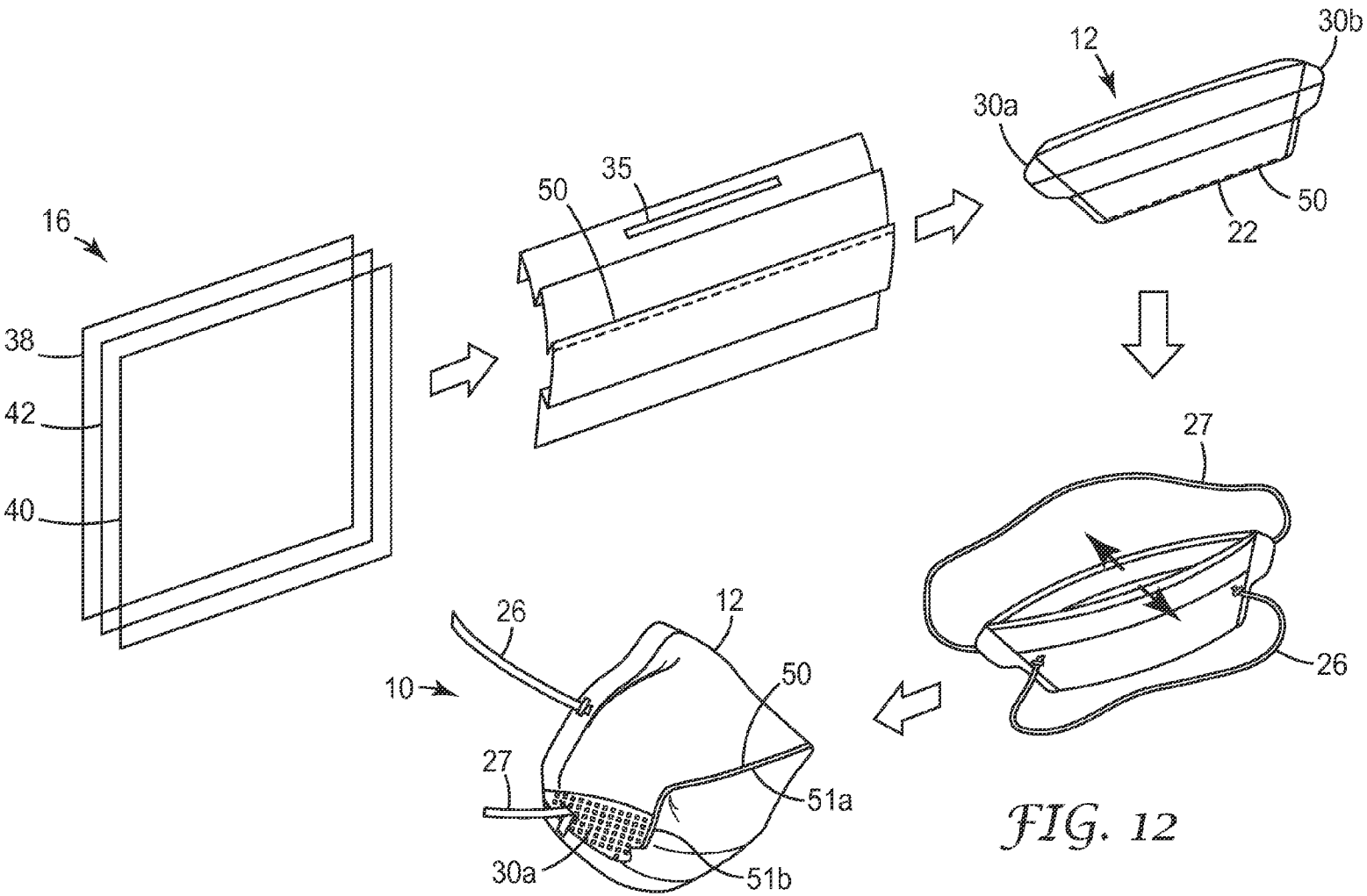
FIG. 12 schematically shows a process for forming a flat-fold filtering face-piece respirator 10 having the mask body 12 and the stiffening member 50.

FIG. 12 illustrates an exemplary method for forming a filtering face-piece respirator 10 having a mask body 12 with at least one stiffening member 50 transversely extending across the mask body 12; particularly, this method forms the mask body 12 of FIGS. 10 and 11.

The respirator 10 is assembled in two operations—mask body making and mask finishing. The mask body making stage includes (a) lamination and fixing of nonwoven fibrous webs to form the filtration structure, (b) formation of various pleat crease lines, (c) formation of stiffening member(s) in the filtering structure, (d) sealing the lateral mask edges, and (e) cutting the final form, which may be done in various sequence(s) or combination(s). The mask finishing operation includes (a) forming a cup-shaped structure, (b) folding the flanges to contact the filtration structure, and (c) attaching a harness (e.g., straps). At least portions of this method can be considered a continuous process rather than a batch process; for example, the mask body can be made by a process that is continuous in the machine direction, including formation of the stiffening member(s).

Referring to FIG. 12, three individual material sheets, an inner cover web 38, an outer cover web 40, and a filtration layer 42, are brought together and plied face-to-face to form an extended length of filtering structure 16. These materials are laminated together, for example, by adhesive, thermal welding, or ultrasonic welding. The resulting filtering structure 16 is cut to desired size, typically a length suitable for a single mask.

A nose clip 35 may be attached to the filtering structure 16, optionally in a pocket formed between the outer cover web 40 and the filtration layer 42.

The filtering structure 16 is manipulated (e.g., folded, pleated) to form various pleats transversely extending across the filtering structure 16. An s-shaped pleat is also formed the length of the filtering structure 16 and welded (e.g., using heat and ultrasonics) to form the stiffening member 50. The s-shaped pleats may be formed in the extending length of filtering structure 16 prior to the filtering structure 16 being cut to length, or may be formed after being cut to length.

The filtering structure 16 is then folded and/or pleated and various seals and bonds are made to form various features, such as the demarcation line 22 and flanges 30*a*, 30*b*, on the flat mask body. In this illustrated method, the demarcation line 22 is positioned on or near the stiffening member 50.

In some embodiments, the material is cut to desired size, typically a length suitable for a single mask, after forming of the demarcation line 22, stiffening member 50, and/or other folds, pleats and various seals and bonds.

The flat mask body 12 is expanded to a cup shape and the flanges 30*a*, 30*b* are folded down, resulting in the mask body 12 of the flat-fold filtering face-piece respirator 10 with a 3-sided trapezoidal-shaped stiffening member 50 having a base side 51*a* and two legs 51*b*. Straps 26, 27 can be added, for example, stapled to flanges 30*a*, 30*b*.

This invention may take on various modifications and alterations without departing from its spirit and scope. Accordingly, this invention is not limited to the above-described but is to be controlled by the limitations set forth in the following claims and any equivalents thereof. As an example, the stiffening member of this invention may be incorporated into 'flat' face masks, such as those commonly used in the medical profession, or in vertical fold face masks, such as described in, for example, U.S. Pat. No. 6,394,090 to Chen et al.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A filtering face-piece respirator that comprises:

(a) a harness; and (b) a mask body that comprises a filtering structure and at least one stiffening member extending transversely across the mask body, the stiffening member formed by the filtering structure being folded into an s-shape and being welded together at a connection region so that three layers of the filtering structure are joined together; wherein the stiffening member has two juxtaposed layers of the filtering structure on each side of the connection region when viewed in cross-section, the two layers extending a distance(L) from the connection region and being juxtaposed for at least 1 mm from the connection region.

2. The filtering face-piece respirator of claim 1, wherein the two juxtaposed layers of the filtering structure on each side of the connection region are non-welded to each other.

3. The filtering face-piece respirator of claim 2 wherein the filtering structure has a thickness (T), the connection region has a thickness that is no greater than the thickness (T), and the two juxtaposed layers of the filtering structure on each side of the connection region have a thickness that is in a range of 1(T) to 2(T).

4. The filtering face-piece respirator of claim 1 wherein the stiffening member extends transversely across the mask body from a first side of the mask body to a second opposing side of the mask body.

5. The filtering face-piece respirator of claim 1, the mask body further comprising first and second flanges located at first and second opposing sides, the first and second flanges each being folded inwardly to contact the filtering structure when the mask body is in an in-use configuration.

6. The filtering face-piece respirator of claim 5 wherein the stiffening member extends transversely across the mask body and along the first and second flanges.

7. The filtering face-piece respirator of claim 6 wherein the stiffening member forms a 3-sided trapezoidal shape having a base side and first and second legs.

8. The filtering face-piece respirator of claim 1 further comprising a second stiffening member formed by the filtering structure being folded into an s-shape and being welded together at a connection region so that three layers of the filtering structure are joined together.

9. A method of making a filtering face-piece respirator that comprises:

forming a mask body having an interior surface and an exterior surface, the mask body comprising a filtering structure;

forming at least one stiffening member in the mask body, wherein the stiffening member comprises a connection region, an interior rib, and an exterior rib, wherein forming the at least one stiffening member comprises:

folding the filtering structure into an s-shape, and connecting the filtering structure together to form the connection region and the interior rib proximate the interior surface of the mask body and the exterior rib proximate the exterior surface of the mask body; wherein the stiffening member has two juxtaposed layers of the filtering structure on each side of the connection region when viewed in cross-section, the two layers extending a distance(L) from the connection region and being juxtaposed for at least 1 mm from the connection region.

10. The method of claim 9 wherein the step of connecting comprises welding.

11. The method of claim 9 wherein the steps of forming a mask body and forming the at least one stiffening member in the mask body are continuous machine direction processes.

* * * * *